US010774530B2

(12) United States Patent
Scherrer

(10) Patent No.: US 10,774,530 B2
(45) Date of Patent: Sep. 15, 2020

(54) STRETCHED-WEB STRUCTURE FOR PRODUCING A FALSE CEILING OR A DROPPED CEILING BOX

(71) Applicant: NORMALU, Kembs (FR)

(72) Inventor: Jean-Marc Scherrer, Riedisheim (FR)

(73) Assignee: NORMALU, Kembs (FR)

( * ) Notice: Subject to any disclaimer, the term of this patent is extended or adjusted under 35 U.S.C. 154(b) by 0 days.

(21) Appl. No.: 15/529,535

(22) PCT Filed: Sep. 25, 2015

(86) PCT No.: PCT/FR2015/052567
§ 371 (c)(1),
(2) Date: May 25, 2017

(87) PCT Pub. No.: WO2016/083681
PCT Pub. Date: Jun. 2, 2016

(65) Prior Publication Data

US 2017/0342711 A1 Nov. 30, 2017

(30) Foreign Application Priority Data

Nov. 26, 2014 (FR) ..... 14 61484

(51) Int. Cl.
*E04B 9/04* (2006.01)
*E04B 9/32* (2006.01)
(Continued)

(52) U.S. Cl.
CPC ..... *E04B 9/0478* (2013.01); *E04B 9/001* (2013.01); *E04B 9/0464* (2013.01); *E04B 9/32* (2013.01);
(Continued)

(58) Field of Classification Search
CPC .... E04B 9/32; E04B 2009/0492; E04B 9/303; E04B 9/006; E04B 9/0478; E04F 13/00;
(Continued)

(56) References Cited

U.S. PATENT DOCUMENTS 3,253,675 A * 5/1966 Baruch ..... E04B 9/001 181/289
5,301,447 A * 4/1994 Lotter ..... G09F 15/0025 160/328
(Continued)

FOREIGN PATENT DOCUMENTS

DE 19943478 A1 * 4/2001 ..... E04B 9/04
DE 19943478 A1 4/2001
(Continued)

OTHER PUBLICATIONS

International Search Report for PCT/FR2015/052567 dated Dec. 4, 2015.

*Primary Examiner* — Jessie T Fonseca
(74) *Attorney, Agent, or Firm* — Bachman & LaPointe, P.C.

(57) ABSTRACT

A stretched-web structure for producing a false ceiling or a dropped ceiling box in a room, including two flexible webs arranged parallel to one another and fastened stretched between at least one wall, wherein one of the webs is made of polyvinyl chloride and the other web is made of fabric.

8 Claims, 1 Drawing Sheet

(51) Int. Cl.
*E04B 9/00* (2006.01)
*F21S 8/04* (2006.01)
*F21V 1/14* (2006.01)

(52) U.S. Cl.
CPC ..... *E04B 2009/0492* (2013.01); *F21S 8/04* (2013.01); *F21V 1/14* (2013.01)

(58) Field of Classification Search
CPC ..... E04F 13/002; E04F 13/005; F21S 8/02; F21S 8/026; F21S 8/04; F21V 1/04; F21V 1/14
See application file for complete search history.

(56) References Cited

U.S. PATENT DOCUMENTS

| | | | | |
|---|---|---|---|---|
| 5,647,155 | A * | 7/1997 | Hillstrom | G09F 15/0025 160/371 |
| 8,083,366 | B1 * | 12/2011 | Backer | F21V 33/006 362/145 |
| 9,745,748 | B2 * | 8/2017 | Bergman | E04B 9/245 |
| 2005/0126848 | A1 * | 6/2005 | Siavoshai | B60R 13/0815 181/207 |

FOREIGN PATENT DOCUMENTS

| | | | | |
|---|---|---|---|---|
| EP | 2157360 | A1 * | 2/2010 | E04B 9/006 |
| EP | 2157360 | A1 | 2/2010 | |
| EP | 2472018 | A1 * | 7/2012 | E04B 1/8409 |
| WO | 0171117 | A1 | 9/2001 | |

* cited by examiner

STRETCHED-WEB STRUCTURE FOR PRODUCING A FALSE CEILING OR A DROPPED CEILING BOX

BACKGROUND OF THE INVENTION

The invention relates to a stretched-web structure for producing within a room, at least one wall element.

The assembly is specifically, but not exclusively, intended to make boxes as well as false ceilings and false walls, whether lighting or not.

Stretched webs made of polymer are commonly used for producing false walls or dropped ceiling boxes, because of their multiple qualities. As a matter of fact, such webs are particularly easy to clean, and tight.

Depending on the desired appearance and effect, fabric webs may however be preferred. As a matter of fact, when it comes especially to creating a cozy and warm atmosphere, polymer webs may be somewhat limited as regards rendering. However, even though fabric webs have a satisfactory behavior in terms of sound and heat insulation, they have the disadvantage of being difficult to maintain and getting dirty quickly. Besides, they do not provide optimum sealing. A quick deterioration of the aesthetic appearance of the false wall or of the dropped wall element equipped with such a web then quickly occurs.

Now, the main drawback of false ceilings and dropped ceiling boxes is the presence of a residual space (awning) between the web and the ceiling or the bottom wall of the box wherein equipment such as lighting means as well as electric cables, pipes, etc . . . are accommodated. As a matter of fact, dust or various residues contained in the awning are deposited on the fabric web, and soil it. The appearance of the false wall or of the box is then rapidly degraded.

The invention aims at remedying such problems by providing a wall element which preserves the rendering of a fabric web over time.

The invention also aims at providing a wall element having enhanced sound-insulating and/or light diffusion properties.

SUMMARY OF THE INVENTION

For this purpose, and according to a first aspect, the invention provides for a stretched-web structure for producing a false ceiling or a dropped ceiling box in a room, including two flexible webs arranged parallel to one another and fastened stretched between at least one wall, with the structure being characterized in that one of the webs is made of polyvinyl chloride, with the other web being made of fabric.

The presence of a PVC web with a fabric web makes it possible to protect the fabric web from dust deposit on the web, while preserving the aesthetic rendering and the (acoustic, thermal and/or other) properties of the fabric web.

The web made of polyvinyl chloride is advantageously positioned over the fabric web.

The web made of polyvinyl chloride advantageously has micro-perforations so arranged as to form an acoustic web. When the structure comprises lighting means such as light-emitting diodes located above the web made of polyvinyl chloride, the web made of polyvinyl chloride can be provided with perforations or micro-perforations so arranged as to improve the diffusion of light from the lighting means while limiting the visibility thereof.

The fabric web advantageously comprises fibers having sound-insulating properties.

The polyvinyl chloride web is advantageously translucent or transparent.

The structure advantageously comprises lighting means arranged in at least one of the two spaces defined by the inner web. The lighting means may for example be light emitting diodes.

Said webs are advantageously fastened to the wall faces of the room so as to form a false ceiling.

The structure advantageously forms a box comprising at least one side wall whereon the webs are fastened.

BRIEF DESCRIPTION OF THE DRAWINGS

Other objects and advantages of the invention will appear in the following description, made while referring to the appended drawings, in which.

For clarity, the identical or similar elements of the various embodiments are identified by identical reference signs on all the figures.

DETAILED DESCRIPTION

Figure 1:
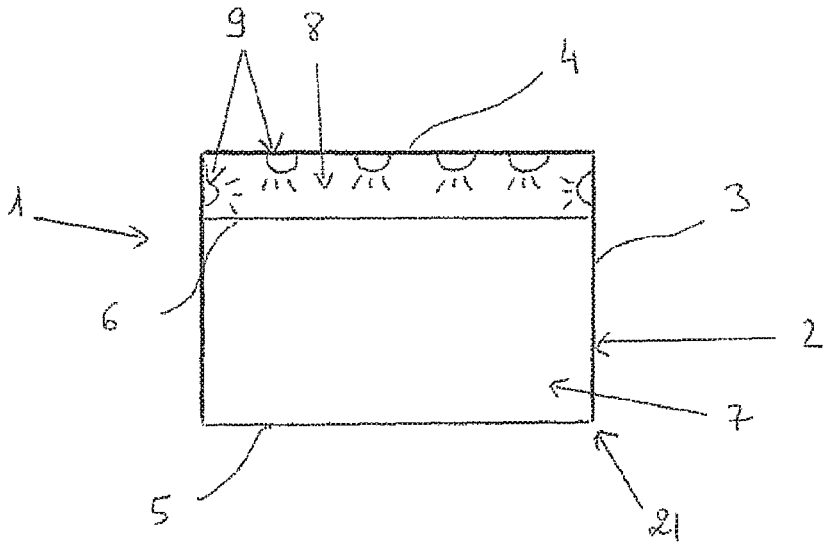
FIG. 1 shows a structure intended to form a wall element according to a first exemplary embodiment of the invention.

While referring to FIG. 1, a structure 1 intended to form, in a room, at least one wall element is disclosed. More particularly, the structure 1 shown is a box able to be fastened to a ceiling by means of suitable fastening means known to those skilled in the art (suspending tie-bars, etc.).

The structure 1 comprises a tubular box body 2 having side walls 3 and an end closed by a bottom wall 4. In the embodiment described, the box body 2 has a parallelepiped shape. It should be understood that the box body 2 is not limited to this shape, and that it may take other forms without departing from the scope of the invention.

The structure 1 comprises two flexible webs 5, 6 fastened stretched between the side walls 3 of the box body 2, with one of the webs being made of polyvinyl chloride (PVC), and the other web being made of fabric.

In order to enable the attachment of the webs 5, 6 onto the box body 2, the inner face 20 of the box body is advantageously provided with fastening means conventionally used for attaching stretched webs (not shown). According to one particular configuration, the box body 2 may consist of one section or several sections positioned end-to-end, with each section forming a rail for receiving hanging means arranged at the peripheral edges of the sheets. Such attachment ensures air-tightness to the structure 1.

The two flexible webs 5, 6, are positioned one below the other at a given distance. They also extend parallel to the bottom wall 4 of the box. The lower web 5 is the web which is visible from the room. It will be called the outer web 5 in the following. The web 6 positioned between the lower web 5 and the bottom wall 4 of the box body 2 forms an inner web. The inner web thus defines, with the bottom wall 4, an upper space 8, and with the outer web, a lower space 7. In the illustrated embodiment, the outer web 5 is provided at the open end 21 of the box body 2. It thus forms an end web. The inner web 6 is arranged inside the box body 2 so as to be at a distance from the lower bottom wall 4 with the outer web.

The inner web 6 is a protective web intended to protect the lower web from soiling.

In the illustrated embodiment, the outer web 5 is the web made of fabric, whereas the inner web 6 is the web made of PVC.

The structure 1 further comprises lighting means 9 provided in the upper space. The lighting means 9 are directly or indirectly fixed on the bottom wall 4 as well as on the side wall portions 3 of the box body 2 located above the inner web 6. To enable light diffusion, the web 6 made of PVC is translucent. The presence of such a web 6, between the fabric web 5 and the portion of the box carrying the lighting means 9, makes it possible to enhance light diffusion, which is thus a more uniform diffusion. The invention is of course not limited to this configuration, since the lighting means 9 may be provided on the bottom wall 4 or on the side wall portions 3 of the box body 2 only. The lighting means 9 may also be arranged in the lower space 7.

Advantageously, the web 6 made of PVC has micro-perforations arranged and distributed over the web to form an acoustically sound-absorbing web. Micro-perforations means any perforation having a diameter of less than or equal to 2 millimeters. The presence of a micro-perforated PVC web thus significantly increases the acoustic performances of the structure 1. In addition to the presence of micro-perforations, the fabric provided to produce the outer web may be selected from fabrics having sound-absorbing or -insulating properties. The web 6 made of PVC may also have perforations or micro-perforations so arranged and distributed thereon as to improve the light diffusion while limiting the visibility of the lighting means 9 provided in the upper space.

In the above, the webs 5, 6 are fastened to a box wall so as to form a dropped ceiling box. The structure according to the invention is however not limited to such use, and the latter may be implemented so as to form a false wall (a false ceiling or a false wall face). In this case, the webs 5, 6 are attached directly to the wall faces, or to the ceiling and the floor, so as to form a false ceiling or a false wall respectively.

Figure 2:
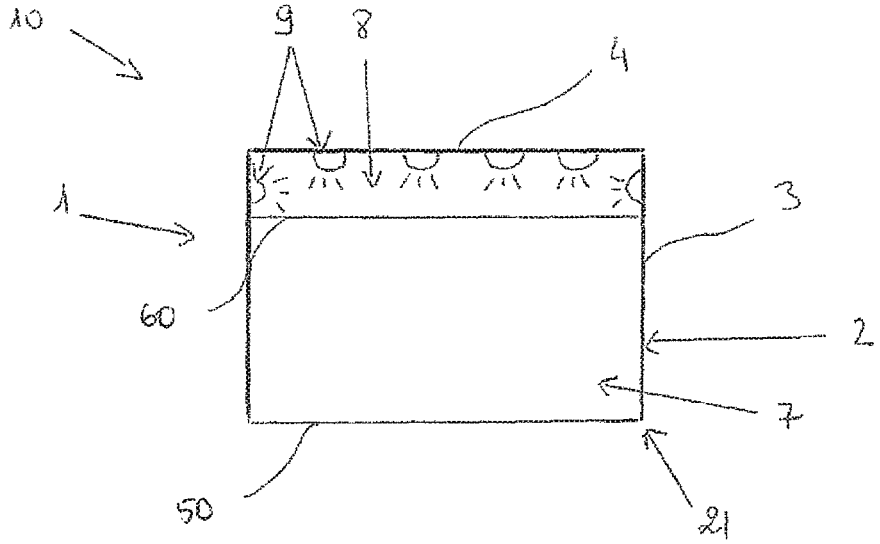
FIG. 2 shows a structure intended to form a wall element according to a second exemplary embodiment of the invention.

Similarly, in the example above, the fabric web forms the outer web of the structure 1 whereas the PVC web forms the intermediate web positioned between the ceiling 4 and the fabric web. Of course, a structure 10 can be provided, wherein the arrangement of the two webs is reversed, so that the outer web 50 is the PVC web and the inner web 60 is the fabric web (FIG. 2). The fabric and PVC webs of the structure 10 have the same characteristics as the webs respectively made of fabric and PVC of the structure 1 described above.

The invention described above should be considered as an example. It should also be understood that the persons skilled in the art will be able to produce various embodiments of the invention without departing from the scope of the invention.

The invention claimed is:

1. A stretched-web structure for producing a false ceiling or a dropped ceiling box in a room, said stretched-web structure comprising two flexible webs made of different materials and arranged parallel to one another, at a distance from each other, and fastened stretched between at least two wall, wherein one of the webs is made of polyvinyl chloride, with the other web being made of textile wherein the web made of polyvinyl chloride is positioned over the web made of textile.

2. The structure according to claim 1, wherein the web made of polyvinyl chloride includes perforations or micro-perforations.

3. The structure according to claim 2, wherein the micro-perforations are so arranged as to form an acoustic web.

4. The structure according to claim 3, wherein the web made of textile comprises fibers having sound-insulating properties.

5. The structure according to claim 4, wherein the web made of polyvinyl chloride is at least one of translucent and transparent.

6. The structure according to claim 5, wherein the structure comprises lighting means arranged in at least one of two spaces defined by an inner web of said two flexible webs.

7. The structure according to claim 6, wherein said webs are fastened to wall faces of the room so as to form a false ceiling.

8. The structure according to claim 7, wherein the structure forms a box comprising the at least two side walk whereon the webs are fastened.

* * * * *